US008585812B2

(12) United States Patent
Cohly et al.

(10) Patent No.: US 8,585,812 B2
(45) Date of Patent: Nov. 19, 2013

(54) OXYGEN DISPLACEMENT TECHNOLOGY (ODT) TO REMOVE RUST FROM IRON AND IRON-BASED TOOLS AND STRUCTURES

(75) Inventors: Hari Har Parshad Cohly, Jackson, MS (US); Rajendram V. Rajnarayanan, East Amherst, NY (US); Bharat Subodh Agrawal, Bogart, GA (US); Hui Chu Tsai, Singapore (SG)

(73) Assignee: Jackson State University, Jackson, MS (US)

( * ) Notice: Subject to any disclaimer, the term of this patent is extended or adjusted under 35 U.S.C. 154(b) by 0 days.

(21) Appl. No.: 13/323,746

(22) Filed: Dec. 12, 2011

(65) Prior Publication Data

US 2012/0318167 A1 Dec. 20, 2012

Related U.S. Application Data

(60) Provisional application No. 61/490,364, filed on May 26, 2011.

(51) Int. Cl.

| | |
|---|---|
| ***C23F 4/00*** | (2006.01) |
| ***C23F 11/00*** | (2006.01) |
| ***C23F 15/00*** | (2006.01) |

(52) U.S. Cl.

USPC ..... 106/14.44; 106/14.05; 252/389.52; 427/331

(58) Field of Classification Search

USPC ..... 106/14.05, 14.44; 252/389.52; 427/331

See application file for complete search history.

(56) References Cited

U.S. PATENT DOCUMENTS

| | | | | |
|---|---|---|---|---|
| 3,262,761 | A * | 7/1966 | Bechtold | 428/539.5 |
| 3,926,698 | A * | 12/1975 | Cook et al. | 149/44 |
| 5,935,894 | A * | 8/1999 | Kanazirev | 502/341 |
| 6,013,600 | A * | 1/2000 | Kanazirev | 502/415 |
| 6,159,898 | A * | 12/2000 | Kanazirev | 502/415 |
| 2005/0233250 | A1 * | 10/2005 | Takagi | 430/300 |
| 2006/0070881 | A1 * | 4/2006 | Takada | 205/69 |

FOREIGN PATENT DOCUMENTS

| | | | | |
|---|---|---|---|---|
| WO | WO2008/033227 | A2 * | 3/2008 | A61K 9/14 |

* cited by examiner

*Primary Examiner* — Anthony J Green

(74) *Attorney, Agent, or Firm* — Butler, Snow, O'Mara, Stevens & Cannada PLLC

(57) ABSTRACT

A novel method for the removal and prevention of rust from corroded iron surfaces is disclosed. This is done by inducing reducing conditions at the interphase between the rusted surface and the attached aluminum surface. An iron coating provided by the reducing conditions surrounds the clean iron and creates a barrier against future rust. Our technology is an oxygen displacement technology which essentially removes rust from iron and iron based tools and structures. It is cost effective, non-invasive, environmentally friendly and can be mass produced.

7 Claims, No Drawings

OXYGEN DISPLACEMENT TECHNOLOGY (ODT) TO REMOVE RUST FROM IRON AND IRON-BASED TOOLS AND STRUCTURES

CROSS-REFERENCES TO RELATED APPLICATIONS

This application claims the benefit of U.S. Provisional Application No. 61/490,364 filed May 26, 2011, incorporated herein by reference in its entirety.

FIELD OF THE INVENTION

The present invention is generally directed toward a method for the removal and prevention of rust from corroded iron surfaces.

BACKGROUND OF THE INVENTION

Iron rust removal and prevention have generated significant interest for many years. The estimated expense due to rusting in the world's economy is over 1%. Several different methods are currently used to corrosion-proof ferrous substrates. The most often used methods for rust removal and rust prevention are electrolysis, applying acids to the rusted iron, and scrubbing the rust off the iron. However, each of these methods leaves much to be desired.

Rust removal, via electrolysis, uses a sacrificial anode made of a metal with a more negative charge than iron, such as zinc, aluminum, or magnesium, in order to remove the rust. However, rust removal using this process is rather expensive due to consumption of electricity and the sacrificial anodes.

Phosphoric acid is the acid most commonly used used for ferrous corrosion removal. Phosphoric acid can be applied to rusted metals to convert the rust to a water-soluble phosphate compound. After adding phosphoric acid to the rusted iron, the iron oxide will convert to a black iron phosphate coating. The coating must then be scraped away in order to expose the clean iron. This method is very inefficient because the phosphoric acid must be repeatedly applied in order to completely remove the rust.

The most rudimentary method used in rust removal is simply scrubbing the rust off the iron. Aluminum is a metal frequently used to scrub the rust off because aluminum possesses a higher reduction potential than iron, which allows the oxygen atoms to transfer from the iron to aluminum. However, the process is labor intensive and is not an effective method to remove rust. All the methods mentioned above are not cost efficient and require a tremendous amount of labor.

In most of the prior art rust conversion processes, there is polymerization of a monomer under conditions whereby the ferrous surface is converted from the trivalent to the divalent state and the monomer polymerizes to form an effective and permanent coating on the rusted surface. However, there exists a need for an economical method for removing and preventing rust.

SUMMARY OF THE INVENTION

We disclose a method for economical rust removal and prevention of rusted iron surfaces. Our claimed methods use inexpensive components such as sodium hydroxide, sodium acetate, and aluminum. Sodium hydroxide, also known as lye, is a common cleaning product. Sodium acetate, is an inexpensive salt. Aluminum, a cheap and common metal, is also used. Our claimed method removes rust under reducing conditions and forms a protective coating around the iron, allowing for the prevention of rust formation. This protective coating is enhanced when placed in the reaction for a long duration of time and when the concentration of sodium hydroxide is higher. Our claimed method also provides a reducing conditions at the interphase of the iron and the rusted iron.

DETAILED DESCRIPTION

The following detailed description is presented to enable any person skilled in the art to make and use the invention. For purposes of explanation, specific details are set forth to provide a thorough understanding of the present invention. However, it will be apparent to one skilled in the art that these specific details are not required to practice the invention. Descriptions of specific applications are provided only as representative examples. Various modifications to the preferred embodiments will be readily apparent to one skilled in the art, and the general principles defined herein may be applied to other embodiments and applications without departing from the scope of the invention. The present invention is not intended to be limited to the embodiments shown, but is to be accorded the widest possible scope consistent with the principles and features disclosed herein.

The present invention provides a novel method of rust removal and prevention under reducing conditions. The disclosed method removes the rusted layer by removing rust from the surface particle by particle. The disclosed composition is a chemical reaction, which involves the reaction of attached aluminum to the iron surface in the presence of sodium hydroxide and sodium acetate. This novel procedure eliminates the requirement of physical scrubbing, electrolysis, applying of acid, or painting over the surface using acids or polymers.

The rust removal and prevention composition of the present invention comprises:

(a) A reaction, which involves aluminum reacting with sodium hydroxide, which will function to provide the conditions for reduction;

(b) A salt, sodium acetate that inhibits the formation of the oxide layer of aluminum on the aluminum surface which if present would eventually stop the reducing conditions; and (c) a continuous connection between the aluminum surface and iron in which iron acts as a catalyst to provide the reducing conditions at the interphase allowing for the rust particles to fall off from the surface.

In one embodiment, the rust removal composition can be applied as a coating. This rust removal coating comprises reducing conditions that will reverse the process of rusting by providing reducing conditions rather than oxidizing conditions that promote rusting. This rust removal coating can be applied to the iron surface, resulting in reduced rusting on a surface that is otherwise prone to rusting. This rust removal is the opposite of oxidation, which is the causative agent in rusting. The reduction is the stimulus for the rust removal phenomenon and the coating of the reducing conditions provides the necessary surface to inhibit rusting. Reducing conditions provide the necessary stimulus for the rusted iron to flake off as soon as the reaction begins.

The reducing conditions may be applied to the rusted iron surface and may be maintained on the rusted surface for several minutes. The rust will become dislodged from the iron surface.

The above reducing conditions are provided in an aqueous solution. In one embodiment, the aqueous solution contains about 10% sodium hydroxide solution (80 ml) with 1% sodium acetate (3 ml) and an aluminum rod weighing about 4 grams (3 mm diameter).

In use, the rust reducing composition is then applied to the rusted iron surface. The excess rust is removed automatically, particle by particle, where the reducing conditions are present at the interphase between the rusted surface and the iron. The composition of the invention is applied as a coating and permitted to react with the metal surface. During this reaction, the protective coat is formed by inducing surface coating, which prevents the rust formations, the reducing agent serves to remove the rust from the rusted surface. Simultaneously, the reducing conditions also provide a coat to the surface of the iron, which is connected to the aluminum rod and thus prevents the iron from rusting. While not being bound by any theory involving the invention, it is believed that the chemistry of the invention proceeds through reduction of iron at the interphase between the rusted surface and aluminum.

EXAMPLES

Experiment 1

Effect of Acetic Acid on Iron

An iron nail (6.4 cm, 8 gm) was placed in a glass bottle containing 80 mL of 5% acetic acid. The iron nail produced small amounts of hydrogen gas. The nail also began to rust. The rust was in a larger concentration in the area where the iron nail was not submerged in the solution. The area where the iron nail was submerged had very little rust build up because hydrogen gas was produced there.

Experiment 1 shows that the presence of acetic acid initiates rust formation in the interface above the acetic acid solution.

Experiment 2

Effect of Aluminum and Sodium Hydroxide with Rusted Iron Nail

A rusted iron nail (6.4 cm, 8 gms) hung from an aluminum rod (9.6 cm, 3 mm diameter, 3.25 gms) and, both were placed in a glass beaker containing 80 mL of 10% sodium hydroxide. The aluminum and rusted iron nail both produced hydrogen gas. The particles of rust on the iron nail began falling off the nail particle by particle.

Experiment 2 shows that hydrogen gas production at the interface between the rusted surface and iron nail initiates a chemical reaction in which the rust coating is sloughed off. Thus, exhibiting that the site of hydrogen production is the central point where the reaction is taking place to dislodge the rusted material from the rusted iron nail. Under these conditions, the reaction slows down due to the coating of aluminum surface with its oxide, $Al_2O_3$.

Experiment 3

Effect of Aluminum and Sodium Hydroxide and Acetic Acid in Rust Removal

A rusted iron nail (6.4 cm, 8 gms) hung from an aluminum rod (9.6 cm, 3 mm diameter, 3.25 gms) and both were placed in a glass beaker containing 80 mL of 10% sodium hydroxide and 3 mL of 5% acetic acid. The aluminum and rusted iron nail produced hydrogen gas on their surfaces. The particles of rust on the nail began falling off the nail.

Experiment 3 shows that the addition of acetic acid enhances the rust removal reaction.

Experiment 4

Effect of Aluminum, Sodium Hydroxide, and Sodium Acetate in Rust Removal

A rusted iron nail (6.4 cm, 8 gms) hung from an aluminum rod (9.6 cm, 3 mm diameter, 3.25 gms) and both were placed in a glass beaker containing 80 mL of 10% sodium hydroxide and 3 mL of 1% sodium acetate. The aluminum and rusted iron nail produced gas on their surfaces. The particles of rust on nail began falling off the nail.

Experiment 4 demonstrates that sodium acetate can be replaced by acetic acid, such as that used in Experiment 3, and that sodium acetate is effective in the reaction that participates in the rust removal of rusted iron nail.

Experiment 5

Effect of Aluminum Surface touching Iron Surface on Rust Removal

In all the experiments, the aluminum must come into contact with the iron, or the rust will not be removed. Aluminum contacting iron allows gas to be produced on the iron's surface. The produced gas removes the rust from the iron nail. This experiment demonstrates that the phenomenon of rust removal is based on the physical touching of the two surfaces, one being the coated iron nail with rust and the other being the aluminum rod.

Experiment 6

The effect of Iron Pre-treatment with Gas

An iron nail that is void of rust (6.4 cm, 8 g) (unrusted) was hung from an aluminum rod (9.6 cm, 3 mm diameter, 3.25 gms); both were placed in a glass beaker containing 80 mL of 10% sodium hydroxide and 3 mL of 5% acetic acid. Iron and aluminum both produced hydrogen gas. The iron nail was then removed from the solution and was placed in a glass beaker containing 80 mL of 5% acetic acid. Less rust occurred on the iron nail.

Experiment 6 demonstrates that a nail that has been pretreated with conditions that produce gas in the presence of aluminum and sodium hydroxide reduces rust formation. Thus, the pre-coating of an iron nail gives protection to the nail enabling decreased rust formation.

Experiment 7

Effect of Time Duration of Iron Pre-treatment

Five glass containers containing 80 mL of 10% sodium hydroxide and 3 mL of 1% sodium acetate were prepared. The solutions were reacted with an iron nail (6.4 cm, 8 gms) hanging from an aluminum rod (9.6 cm, 3 mm diameter, 3.25 gms). Reactions were allowed to proceed in the glass containers for varying durations including five, ten, thirty, sixty, and ninety minutes. After completion of the prescribed time, the pretreated nails were then placed in acetic acid for 2 hours. The nails pretreated for a longer duration produced less rust than the nails pretreated for a shorter duration.

Experiment 7 demonstrates that longer durations of pretreatment of iron with aluminum and sodium hydroxide and sodium acetate allows for greater protection from rust formation.

Experiment 8

Effect of Sodium Hydroxide Concentration on Iron Pre-treatment

Two glass containers, one containing 80 mL of 10% sodium hydroxide and 3 mL of 1% sodium acetate and the other one containing 80 mL of 1% sodium hydroxide and 3 mL of 1% sodium acetate are reacted with an iron nail (6.4 cm, 8 gms) hanging from an aluminum rod (9.6 cm, 3 mm diameter, 3.25 gms). The nails were removed from the solutions and placed in a glass beaker containing 80 mL of 5% acetic acid. The nail in the reaction, using 10% sodium hydroxide, allowed less rust to form upon its surface than the nail in the reaction using 1% sodium hydroxide.

Experiment 8 demonstrates that reaction is sodium hydroxide dependent. The higher the concentration of sodium hydroxide, the greater the protection from rust formation will occur.

The method of chemical interactions can be discerned from the experiments and embodiments disclosed herein. Specifically, it should be appreciated that the presence of acetic acid initiates rust formation at the inter-phase above the acetic acid solution. Acetic acid is corrosive to metals like iron, forming hydrogen gas and metal salts called acetates.

Furthermore, the hydrogen gas production at the interphase, between the aluminum and iron nail, initiates a chemical reaction in which the rust coating is sloughed off. Thus, the site of hydrogen production is where the reduction is taking place to dislodge the rusted material from the rusted iron nail. Under these conditions, the reaction slows down due to the coating of aluminum surface with its oxide, $Al_2O_3$. The addition of acetic acid enhances the rust removal reaction by inhibiting the aluminum coating by the formation of $Al_2O_3$. Acetic acid can be replaced by sodium acetate from experiment 3. Sodium acetate is effective in the reaction that participates in the rust removal of rusted iron nail.

The above experiments also show that the phenomenon of rust removal is based on the physical touching of the two surfaces: the coated iron nail with rust and the aluminum rod.

Finally, it should be appreciated that a nail that has been pretreated, with conditions that produce gas in the presence of aluminum and sodium hydroxide, reduces rust formation. Thus, the pre-coating of an iron nail gives protection to the nail, enabling less rust formation in the future. The longer duration of pretreatment in this reaction allows for more protection of iron from rust formation. A higher concentration of sodium hydroxide enhances the protection of iron from rust formation. Therefore, our claimed method depends on the concentration of sodium hydroxide and the length of time the rusted iron is in the reaction.

The experiments disclosed herein are presented as embodiments of the invention but the invention should not be considered as limited to the experiments. In the experiments solutions concentrations are given by volume.

The terms "comprising," "including," and "having," as used in the claims and specification herein, shall be considered as indicating an open group that may include other elements not specified. The terms "a," "an," and the singular forms of words shall be taken to include the plural form of the same words, such that the terms mean that one or more of something is provided. The term "one" or "single" may be used to indicate that one and only one of something is intended. Similarly, other specific integer values, such as "two," may be used when a specific number of things is intended. The terms "preferably," "preferred," "prefer," "optionally," "may," and similar terms are used to indicate that an item, condition or step being referred to is an optional (not required) feature of the invention.

The invention has been described with reference to various specific and preferred embodiments and techniques. However, it should be understood that many variations and modifications may be made while remaining within the spirit and scope of the invention. It will be apparent to one of ordinary skill in the art that methods, devices, device elements, materials, procedures and techniques other than those specifically described herein can be applied to the practice of the invention as broadly disclosed herein without resort to undue experimentation. All art-known functional equivalents of methods, devices, device elements, materials, procedures and techniques described herein are intended to be encompassed by this invention. Whenever a range is disclosed, all subranges and individual values are intended to be encompassed. This invention is not to be limited by the embodiments disclosed, including any shown in the drawings or exemplified in the specification, which are given by way of example and not of limitation.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

We claim:

1. A method for removing rust from a metal comprising coating rusted metal with a solution comprising sodium hydroxide and acetic acid, said solution also containing non-dissolved aluminum, wherein said non-dissolved aluminum is in direct contact with said rusted metal.

2. The method of claim 1 wherein the metal is iron.

3. A method for removing rust from iron comprising coating rusted iron with a solution comprising sodium hydroxide and sodium acetate, said solution also containing non-dissolved aluminum, wherein said non-dissolved aluminum is in direct contact with said rusted iron.

4. A method of increasing rust preventive properties of a coating composition comprising sodium hydroxide, acetic acid, and non-dissolved aluminum comprising the step of increasing a concentration of sodium hydroxide in the coating composition to more than 1%, wherein said non-dissolved aluminum is in direct contact with a metal.

5. A method of increasing rust preventive properties of a chemical mixture comprising sodium hydroxide, sodium acetate, and non-dissolved aluminum comprising the step of increasing a concentration of sodium hydroxide in the chemical mixture to more than 1%, wherein said non-dissolved aluminum is in direct contact with a metal.

6. A method of increasing rust preventive properties of a coating composition comprising sodium hydroxide, acetic acid, and non-dissolved aluminum comprising the steps of applying the coating composition to a metal surface and increasing duration of exposure of said metal surface to the coating composition, wherein said non-dissolved aluminum is in direct contact with said metal.

7. A method of increasing rust preventive properties of a chemical mixture comprising sodium hydroxide, sodium acetate, and non-dissolved aluminum comprising the steps of applying the chemical mixture to a metal surface and increasing duration of exposure of said metal surface to said chemical mixture, wherein said non-dissolved aluminum is in direct contact with said metal.

* * * * *